US010058988B1

(12) United States Patent
Pintal

(10) Patent No.: US 10,058,988 B1
(45) Date of Patent: Aug. 28, 2018

(54) MULTI-TOOL HAMMER

(71) Applicant: David R. Pintal, Dery, NH (US)

(72) Inventor: David R. Pintal, Dery, NH (US)

( * ) Notice: Subject to any disclaimer, the term of this patent is extended or adjusted under 35 U.S.C. 154(b) by 141 days.

(21) Appl. No.: 15/276,938

(22) Filed: Sep. 27, 2016

(51) Int. Cl.

| | |
|---|---|
| ***B25F 1/00*** | (2006.01) |
| ***B25F 1/02*** | (2006.01) |
| ***B66F 15/00*** | (2006.01) |
| ***A46B 15/00*** | (2006.01) |

(52) U.S. Cl.
CPC ..... *B25F 1/006* (2013.01); *A46B 15/0081* (2013.01); *B25F 1/02* (2013.01); *B66F 15/00* (2013.01)

(58) Field of Classification Search
CPC ..... B25F 1/0006; B25F 1/02; A46B 15/0081
USPC ..... 7/143
See application file for complete search history.

(56) References Cited

U.S. PATENT DOCUMENTS

| | | | | | |
|---|---|---|---|---|---|
| 810,987 | A * | 1/1906 | Spicer | B25F 1/02 | 172/375 |
| 1,580,528 | A * | 4/1926 | Perkins | B25F 1/02 | 7/145 |
| 1,598,420 | A | 8/1926 | Edward | | |
| 2,501,757 | A * | 3/1950 | Cagle | B25D 1/02 | 30/308.3 |
| 2,674,794 | A * | 4/1954 | Baker | B44D 3/162 | 15/105 |
| 3,561,023 | A * | 2/1971 | Shandel | B25F 1/02 | 7/116 |
| 4,958,395 | A * | 9/1990 | Busskohl | B23D 61/121 | 30/144 |
| 5,097,554 | A | 3/1992 | McLaughlin | | |
| 5,255,575 | A | 10/1993 | Williams | | |
| 6,427,274 | B1 | 8/2002 | Abbott | | |
| D496,244 | S | 9/2004 | Boydon | | |
| 8,468,630 | B2 * | 6/2013 | Barnhart | B25B 27/0078 | 7/143 |
| 2006/0048305 | A1 | 3/2006 | Giordano | | |
| 2009/0106919 | A1 | 4/2009 | Montgomery | | |
| 2010/0263133 | A1 * | 10/2010 | Langan | B25D 1/00 | 7/143 |
| 2012/0096659 | A1 * | 4/2012 | Marsden | A46B 5/02 | 15/111 |

* cited by examiner

*Primary Examiner* — Hadi Shakeri

(57) ABSTRACT

The multi-tool includes a handle member that is further defined with a first distal end and a second distal end. Both the first distal end and the second distal end include a threaded cavity. The hammer is provided at the first distal end, whereas a pry bar attachment is able to screw onto the second distal end. The handle member includes a brush member and fixed scraper that afford different functions, and are located on opposing surfaces. The multi-tool hammer also includes an extension member and a large scraper attachment that may be used in lieu of or in conjunction with either the hammer or the pry bar attachment.

12 Claims, 4 Drawing Sheets

MULTI-TOOL HAMMER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hand tools, more specifically, a multi-tool hammer.

SUMMARY OF THE INVENTION

An embodiment of the disclosure meets the needs presented above by generally comprising a multi-tool that includes a hammer. The multi-tool includes a handle member that is further defined with a first distal end and a second distal end. Both the first distal end and the second distal end include a threaded cavity. The hammer is provided at the first distal end, whereas a pry bar attachment is able to screw onto the second distal end. The handle member includes a brush member and fixed scraper that afford different functions, and are located on opposing surfaces. The multi-tool hammer also includes an extension member and a large scraper attachment that may be used in lieu of or in conjunction with either the hammer or the pry bar attachment.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
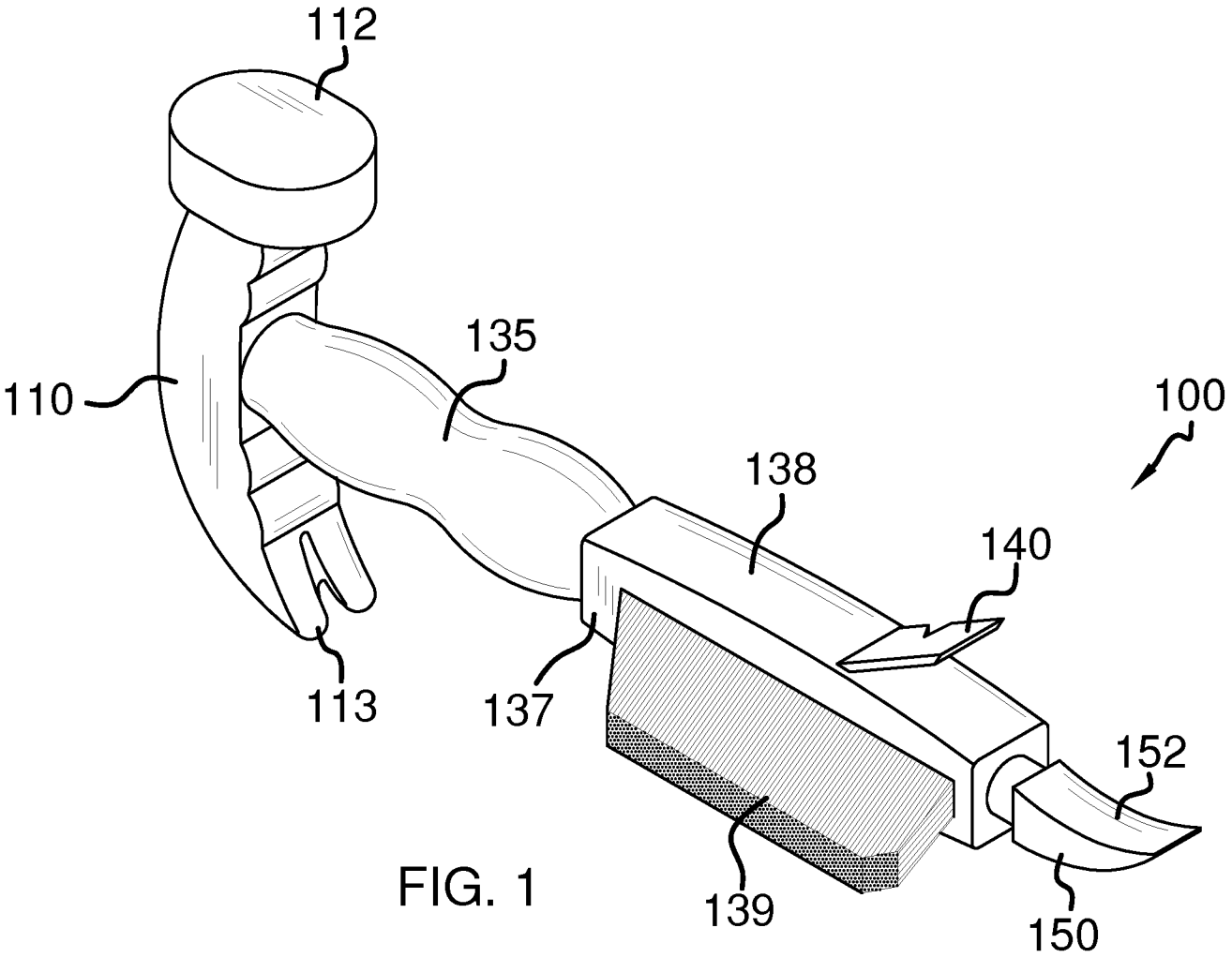
FIG. 1 is a perspective view of the multi-tool hammer.
Figure 2:
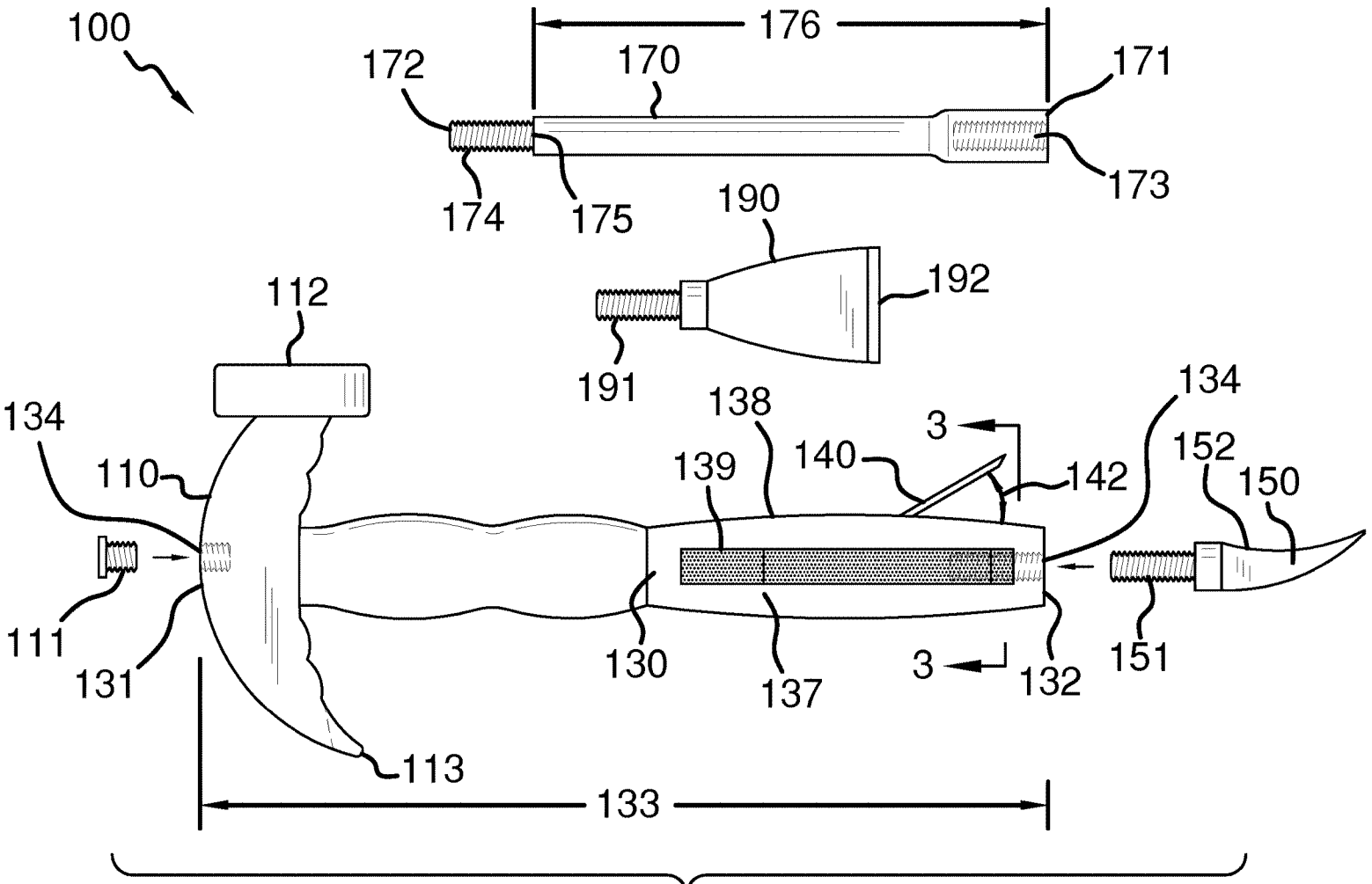
FIG. 2 is a side view of the multi-tool hammer, the extension member, the larger scraper attachment, and the pry bar attachment.
Figure 3:
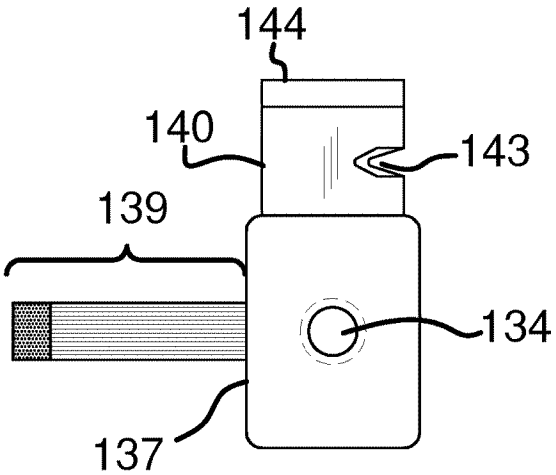
FIG. 3 is a cross-sectional view of the multi-tool hammer along line 3-3 in FIG. 2.
Figure 4:
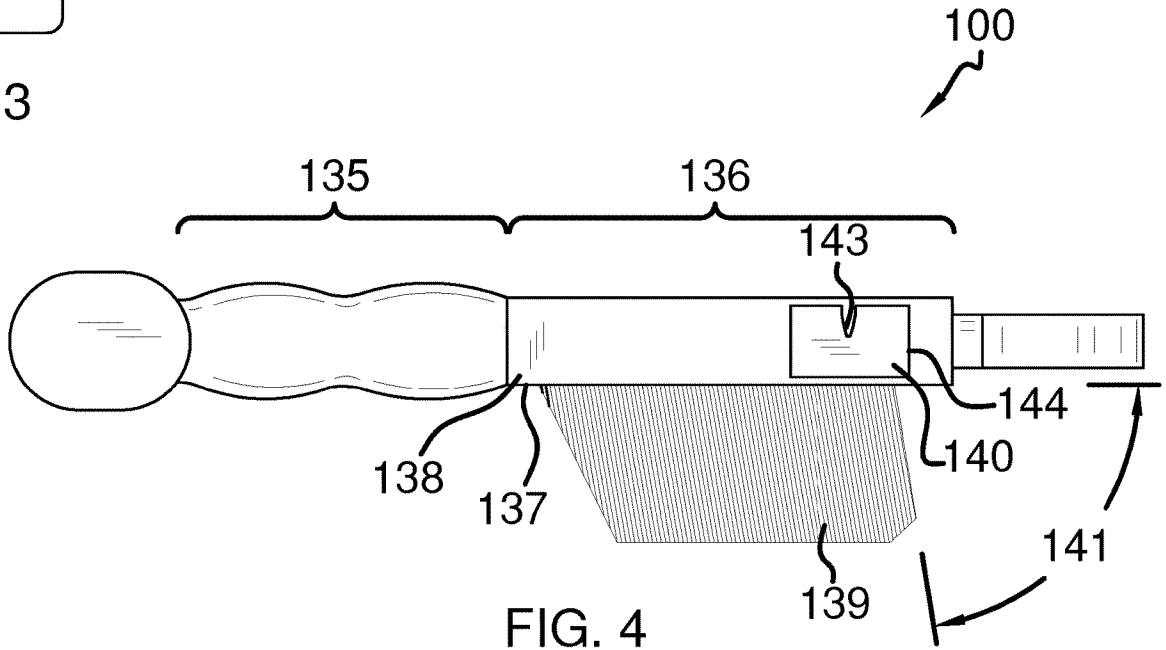
FIG. 4 is a top view of the multi-tool hammer.
Figure 5:
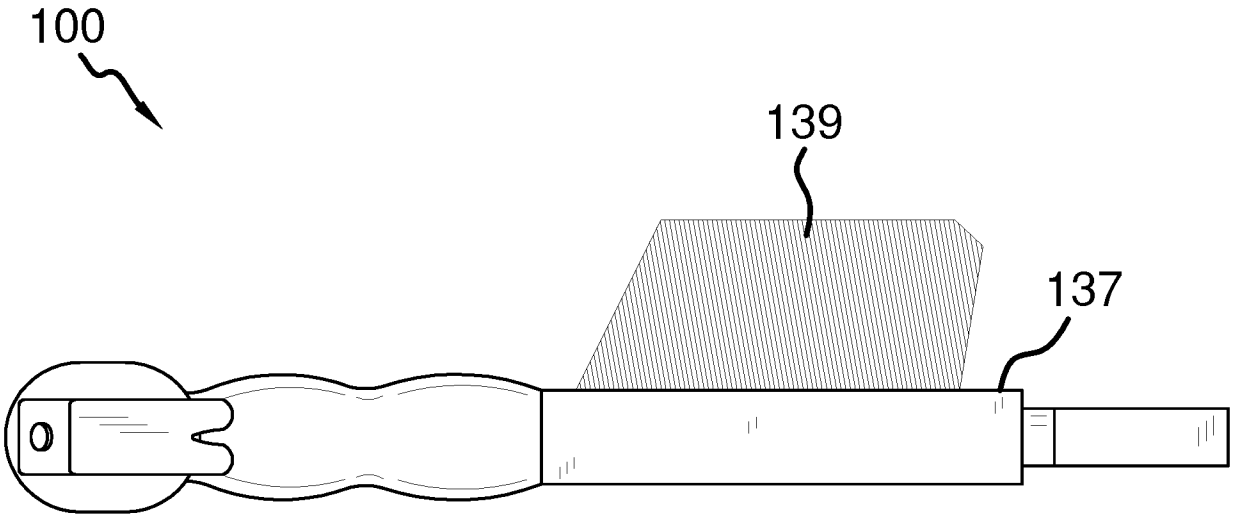
FIG. 5 is a bottom view of the multi-tool hammer.

As best illustrated in FIGS. 1 through 5, the multi-tool hammer 100 (hereinafter invention) generally comprises a hammer 110, a handle member 130, a pry bar attachment 150, an extension member 170, and a large scraper attachment 190.

The handle member 130 and the hammer 110 are permanently affixed to one another. Collectively, the handle member 130 and the hammer 110 shall be further defined with a first distal end 131 and a second distal end 132. The first distal end 131 is opposite of the second distal end 132. The first distal end 131 and the second distal end 132 define a handle member length 133. Both the first distal end 131 and the second distal end 132 include threaded cavities 134, which enable other components of the invention 100 to be threadably screwed to the respective distal end.

The handle member 130 is further defined with a handle grip portion 135, and a non-grip portion 136. The handle grip portion 135 includes a series of ridges, which provides enhanced gripping action. The non-grip portion 136 is further defined with a first surface 137 and a second surface 138. The first surface 137 includes a brush member 139 thereon, whereas the second surface 138 includes a fixed scraper 140 thereon. The brush member 139 extends at an acute brush angle 141 whereas the fixed scraper 140 is oriented at an acute scraper angle 142. The fixed scraper 141 includes a nail slot 143 at a distal scraper edge 144.

The hammer 110 is further defined with a hammer face 112. The hammer 110 is further defined with a claw 113, which is on an opposing side of the hammer 110 with respect to the hammer face 112. The first distal end 131 is located on the hammer 110, and includes one of the threaded cavities 134 mentioned above. Moreover, the threaded cavity 134 is temporarily sealed with a threaded member 111.

The extension member 170 is further defined as a component of the invention 100 that will increase the distance afforded between either the first distal end 131 or the second distal end 132 of the handle member 130 with respect to the hammer 110, pry bar attachment 150, or large scraper attachment 190. The extension member 170 is further defined with a first extension end 171 and a second extension end 172. The first extension end 171 includes a threaded extension cavity 173 whereas the second extension end 172 includes a threaded extension member 174. The threaded extension member 174 being able to screw into the threaded cavity 134 of either the first distal end 131 or the second distal end 132. The extension member 170 includes a shoulder 175 where the threaded extension member 174 extends towards the second extension end 172. An extension member length 176 is defined from the shoulder 175 to the first extension end 171. The extension member length 176 defines the applicable distance added between the handle member 130 and either the hammer 110, the pry bar attachment 150, or the large scraper attachment 190.

The large scraper attachment 190 is further defined with a large scraper threaded member 191 that is able to screw onto either the threaded cavity 134 of either the first distal end 131 or the second distal end 132 of the handle member 130. Optionally, the large scraper threaded member 191 may be screwed onto the threaded extension cavity 173 of the extension member 170 in conjunction with the handle member 130. The large scraper attachment 190 includes a large scraper edge 192, which is opposite of the large scraper threaded member 191.

The pry bar attachment 150 includes a pry bar threaded member 151 that is able to screw onto either the threaded cavity 134 of either the first distal end 131 or the second distal end 132 of the handle member 130. Optionally, the pry bar threaded member 151 may be screwed onto the threaded extension cavity 173 of the extension member 170 in conjunction with the handle member 130. The pry bar attachment 150 includes a curved surface 152, which is useful in obtaining a mechanical leverage when prying action is applied.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-tool hammer comprising:

a handle member, a hammer, an extension member, a large scraper attachment, and a pry bar attachment;

wherein the handle member is permanently affixed to the hammer;

wherein the handle member and the hammer each include one of two threaded cavities that enable the pry bar attachment to attach or detach as needed;

wherein the handle member and the hammer shall be further defined with a first distal end and a second distal end;

wherein the first distal end is opposite of the second distal end;

wherein the first distal end and the second distal end define a handle member length;

wherein both the first distal end and the second distal end each include one of said two threaded cavities;

wherein the handle member is further defined with a handle grip portion, and a non-grip portion;

wherein the handle grip portion includes a series of ridges, which provides enhanced gripping action;

wherein the non-grip portion is further defined with a first surface and a second surface;

wherein the first surface includes a brush member thereon, whereas the second surface includes a fixed scraper thereon;

wherein the brush member extends at an acute brush angle whereas the fixed scraper is oriented at an acute scraper angle;

wherein the fixed scraper includes a nail slot at a distal scraper edge.

2. The multi-tool hammer according to claim 1 wherein the hammer is further defined with a hammer face; wherein the hammer is further defined with a claw, which is on an opposing side of the hammer with respect to the hammer face.

3. The multi-tool hammer according to claim 2 wherein the first distal end is located on the hammer, and includes one of the two threaded cavities.

4. The multi-tool hammer according to claim 3 wherein the one of two threaded cavities of the hammer is temporarily sealed with a threaded member.

5. The multi-tool hammer according to claim 4 wherein the extension member is further defined with a first extension end and a second extension end; wherein the first extension end includes a threaded extension cavity whereas the second extension end includes a threaded extension member.

6. The multi-tool hammer according to claim 5 wherein the threaded extension member is optionally screwed into either of the two threaded cavities provided at the first distal end or the second distal end.

7. The multi-tool hammer according to claim 6 wherein the extension member includes a shoulder where the threaded extension member extends towards the second extension end.

8. The multi-tool hammer according to claim 7 wherein an extension member length is defined from the shoulder to the first extension end; wherein the extension member length defines an applicable distance added between the handle member and either the pry bar attachment, or the large scraper attachment.

9. The multi-tool hammer according to claim 8 wherein the large scraper attachment is further defined with a large scraper threaded member that is able to screw onto either the two threaded cavities provided at the first distal end or the second distal end.

10. The multi-tool hammer according to claim 9 wherein the large scraper attachment includes a large scraper edge, which is opposite of the large scraper threaded member.

11. The multi-tool hammer according to claim 10 wherein the pry bar attachment includes a pry bar threaded member that is able to screw onto either of the two threaded cavities provided at the first distal end or the second distal end.

12. The multi-tool hammer according to claim 11 wherein the pry bar attachment includes a curved surface.

* * * * *